US010087500B2

(12) United States Patent
Makimizu et al.

(10) Patent No.: US 10,087,500 B2
(45) Date of Patent: Oct. 2, 2018

(54) METHOD FOR MANUFACTURING HIGH-STRENGTH GALVANNEALED STEEL SHEET

(71) Applicant: JFE STEEL CORPORATION, Tokyo (JP)

(72) Inventors: Yoichi Makimizu, Tokyo (JP); Yoshitsugu Suzuki, Tokyo (JP); Yasunobu Nagataki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 394 days.

(21) Appl. No.: 14/891,850

(22) PCT Filed: May 19, 2014

(86) PCT No.: PCT/JP2014/002621
§ 371 (c)(1),
(2) Date: Nov. 17, 2015

(87) PCT Pub. No.: WO2014/188697
PCT Pub. Date: Nov. 27, 2014

(65) Prior Publication Data

US 2016/0102379 A1 Apr. 14, 2016

(30) Foreign Application Priority Data

May 21, 2013 (JP) ..... 2013-106762

(51) Int. Cl.

| | |
|---|---|
| ***C21D 9/46*** | (2006.01) |
| ***C23C 2/06*** | (2006.01) |
| ***C23C 2/28*** | (2006.01) |
| ***C23C 2/40*** | (2006.01) |
| ***C21D 1/26*** | (2006.01) |
| ***C22C 38/02*** | (2006.01) |
| ***C22C 38/04*** | (2006.01) |
| ***C22C 38/58*** | (2006.01) |
| ***C21D 1/74*** | (2006.01) |
| ***C21D 6/00*** | (2006.01) |
| ***C22C 38/00*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C23C 2/02*** | (2006.01) |
| ***C23C 2/12*** | (2006.01) |

(52) U.S. Cl.
CPC ..... *C21D 9/46* (2013.01); *C21D 1/26* (2013.01); *C21D 1/74* (2013.01); *C21D 6/004* (2013.01); *C21D 6/005* (2013.01); *C21D 6/008* (2013.01); *C22C 38/002* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C23C 2/02* (2013.01); *C23C 2/06* (2013.01); *C23C 2/12* (2013.01); *C23C 2/28* (2013.01); *C23C 2/285* (2013.01); *C23C 2/40* (2013.01)

(58) Field of Classification Search
CPC ..... C21D 9/46
See application file for complete search history.

(56) References Cited

U.S. PATENT DOCUMENTS 8,303,739 B2 * 11/2012 Ishizuka ..... C23C 2/02 148/529

FOREIGN PATENT DOCUMENTS

| | | | |
|---|---|---|---|
| CA | 2836118 | A1 | 12/2012 |
| CN | 101163812 | A | 4/2008 |
| JP | S55-122865 | A | 9/1980 |
| JP | H04-202630 | A | 7/1992 |
| JP | H04-202631 | A | 7/1992 |
| JP | H04-202632 | A | 7/1992 |
| JP | H04-202633 | A | 7/1992 |
| JP | H04-254531 | A | 9/1992 |
| JP | H04-254532 | A | 9/1992 |
| JP | 2008-214752 | A | 9/2008 |
| JP | 2008-266778 | A | 11/2008 |

(Continued)

OTHER PUBLICATIONS

Sep. 1, 2016 Office Action issued in Korean Patent Application No. 2015-7030769.

(Continued)

*Primary Examiner* — Jessee R Roe
*Assistant Examiner* — Jophy S. Koshy
(74) *Attorney, Agent, or Firm* — Oliff PLC

(57) ABSTRACT

There is provided a method for manufacturing a high-strength galvannealed steel sheet having excellent coating adhesiveness and corrosion resistance whose base material is a high-strength steel sheet containing Si and Mn. The method includes performing an oxidation treatment on a steel sheet including Si and Mn in a first zone having an atmosphere of an oxygen concentration in the range of more than 0 vol % and less than 1 vol %, thereafter performing an oxidation treatment in a second zone having an atmosphere of an oxygen concentration in the range of 1 vol % or more, thereafter performing reduction annealing and galvanizing, and further performing an alloying treatment by heating the galvanized steel sheet.

6 Claims, 1 Drawing Sheet

(56) References Cited

FOREIGN PATENT DOCUMENTS

| | | | |
|---|---|---|---|
| JP | 2011-214042 | A | 10/2011 |
| JP | 2013-014834 | A | 1/2013 |

OTHER PUBLICATIONS

Oct. 19, 2016 Office Action issued in Chinese Patent Application No. 201480029440.8.
Jul. 29, 2014 Search Report issued in International Application No. PCT/JP2014/002621.
May 23, 2016 Search Report issued in European Patent Application No. 14800984.8.

* cited by examiner (a) 8°C/sec (b) 20°C/sec (a) 8°C/sec (b) 20°C/sec

METHOD FOR MANUFACTURING HIGH-STRENGTH GALVANNEALED STEEL SHEET

TECHNICAL FIELD

Disclosed embodiments relate to a method for manufacturing a high-strength galvannealed steel sheet having excellent coating adhesiveness and corrosion resistance whose base material is a high-strength steel sheet containing Si and Mn.

BACKGROUND

Nowadays, steel sheets which are subjected to a surface treatment and provided with a rust prevention property, in particular, galvanized steel sheets or galvannealed steel sheets having excellent rust prevention property, are used as base steel sheets in the fields of automobile, domestic electrical appliance, and building material industries. In addition, the application of high-strength steel sheets to automobiles is being promoted in order to achieve weight reduction and strengthening of automobile bodies by decreasing the thickness of the materials of automobile bodies by increasing the strength of the materials from the viewpoint of an increase in the fuel efficiency of automobiles and the collision safety of automobiles.

In general, a galvanized steel sheet uses a steel sheet as a base material. The steel sheet is produced by hot-rolling a slab and cold-rolling the hot rolled steel sheet. The galvanized steel sheet is manufactured by performing recrystallization annealing on the base steel sheet in an annealing furnace used in a continuous galvanizing line (hereinafter, simply referred to as CGL), and by thereafter galvanizing the annealed steel sheet. In addition, a galvannealed steel sheet is manufactured by further performing an alloying treatment on the galvanized steel sheet.

It is effective to add Si and Mn in order to increase the strength of a steel sheet. However, in continuous annealing, Si and Mn oxidize and form oxides of Si and Mn on the outermost surface of the steel sheet even in a reducing atmosphere of $N_2$+$H_2$ in which oxidation of Fe does not occur (that is, oxidized Fe is reduced). Since oxides of Si and Mn decrease wettability between molten zinc and a base steel sheet when a coating treatment is performed, non-plating frequently occurs in a steel sheet to which Si and Mn have been added. In addition, even if non-plating does not occur, there is a problem in that coating adhesiveness is poor.

As described above, it is effective to add solid solution strengthening elements such as Si and Mn in order to increase the strength of a steel sheet. However, since oxides of Si and Mn are formed on the surface of a steel sheet in an annealing process, it is difficult to achieve sufficient adhesiveness between the steel sheet and the coating layer. Therefore, it is effective to first form a coating composed of iron oxides on the surface of a steel sheet by oxidizing the steel sheet and then to perform reduction annealing on the oxidized steel sheet.

As an example of a method for manufacturing a galvanized steel sheet whose base material is a high-strength steel sheet containing a large amount of Si, Patent Literature 1 discloses a method in which reduction annealing is performed after an oxide layer has been formed on the surface of the steel sheet. However, in the case of Patent Literature 1, it is not possible to stably realize the effect. Patent Literature 2 to Patent Literature 9 disclose techniques for stabilizing the effect, by specifying an oxidation rate and the degree of reduction or by controlling an oxidation condition and a reduction condition in accordance with the observation result of the thickness of an oxide layer which has been obtained in an oxidation zone.

CITATION LIST

Patent Literature

PTL 1: Japanese Unexamined Patent Application Publication No. 55-122865

PTL 2: Japanese Unexamined Patent Application Publication No. 4-202630

PTL 3: Japanese Unexamined Patent Application Publication No. 4-202631

PTL 4: Japanese Unexamined Patent Application Publication No. 4-202632

PTL 5: Japanese Unexamined Patent Application Publication No. 4-202633

PTL 6: Japanese Unexamined Patent Application Publication No. 4-254531

PTL 7: Japanese Unexamined Patent Application Publication No. 4-254532

PTL 8: Japanese Unexamined Patent Application Publication No. 2008-214752

PTL 9: Japanese Unexamined Patent Application Publication No. 2008-266778

SUMMARY

Technical Problem

As described above, it is effective to add solid solution strengthening elements such as Si and Mn in order to increase the strength of a steel sheet. However, since oxides of Si and Mn are formed on the surface of a steel sheet in an annealing process, it is difficult to achieve sufficient adhesiveness between the steel sheet and the coating layer. Therefore, as disclosed in Patent Literature 1 to Patent Literature 9, it is effective to first form a layer composed of iron oxides on the surface of a steel sheet by oxidizing the steel sheet and then to perform reduction annealing on the oxidized steel sheet. In addition, Patent Literature 8 and Patent Literature 9 disclose techniques in which zinc coatability is further increased by performing rapid heating for an oxidation treatment.

However, in the case where the methods for manufacturing a galvanized steel sheet according to Patent Literature 1 to Patent Literature 9 are used, since internal oxidation excessively progresses, the crystal grains of base steel are taken into a coating layer when an alloying treatment is performed. Also, it was found that, in the case where such take-in of base steel occurs, it is not possible to achieve satisfactory corrosion resistance.

Disclosed embodiments have been completed in view of the situation described above, and an object of disclosed embodiments is to provide a method for manufacturing a high-strength galvannealed steel sheet having excellent coating adhesiveness and corrosion resistance whose base material is a high-strength steel sheet containing Si and Mn.

Solution to Problem

From the results of investigations, in the case where a high-strength steel sheet containing Si and Mn is used as a base material, it is possible to obtain a high-strength galvannealed steel sheet having excellent corrosion resistance with a stable quality level by controlling an average heating rate and an oxidation temperature in an oxidation furnace to thereby suppress excessive internal oxidation being formed, achieve excellent coating adhesiveness, and prevent the crystal grains of base steel from being taken into a coating layer.

Disclosed embodiments have been completed on the basis of the knowledge described above and is characterized as follows.

[1] A method for manufacturing a high-strength galvannealed steel sheet, the method including:

performing an oxidation treatment on a steel sheet containing Si and Mn in a zone having an atmosphere of an oxygen concentration: less than 1 vol % under conditions that an average heating rate of the steel sheet is 20° C./sec or more and a maximum temperature T of the steel sheet is 400° C. or higher and 500° C. or lower, thereafter performing an oxidation treatment in a zone having an atmosphere of an oxygen concentration: 1 vol % or more under conditions that an average heating rate of the steel sheet is less than 10° C./sec and a maximum temperature of the steel sheet is 600° C. or higher, thereafter performing reduction annealing and galvanizing, and further performing an alloying treatment by heating the galvanized steel sheet at a temperature of 460° C. or higher and 600° C. or lower for 10 seconds or more and 60 seconds or less.

[2] The method for manufacturing a high-strength galvannealed steel sheet according to item [1], wherein the maximum temperature T in the zone having an oxygen concentration of 1 vol % or more further satisfies the relational expression below:

$$T \leq -80[\mathrm{Mn}]-75[\mathrm{Si}]+1030, \text{ where}$$

[Si] represents Si content (mass %) in the steel sheet and [Mn] represents Mn content (mass %) in the steel sheet.

[3] The method for manufacturing a high-strength galvannealed steel sheet according to item [1] or [2], wherein the steel sheet has a chemical composition containing C: 0.01 mass % or more and 0.20 mass % or less, Si: 0.5 mass % or more and 2.0 mass % or less, Mn: 1.0 mass % or more and 3.0 mass % or less, and the balance being Fe and inevitable impurities.

Here, in disclosed embodiments, "high-strength" refers to a case where a tensile strength TS is 440 MPa or more. In addition, the meaning of "high-strength galvannealed steel sheet" according to embodiments includes both a cold-rolled steel sheet and a hot-rolled steel sheet.

Advantageous Effects

According to embodiments, it is possible to obtain a high-strength galvannealed steel sheet having excellent coating adhesiveness and corrosion resistance whose base material is a high-strength steel sheet containing Si and Mn.

DETAILED DESCRIPTION

Disclosed embodiments will be specifically described hereafter.

First, an oxidation treatment which is performed before an annealing process will be described. As described above, it is effective to add such chemical elements as Si and Mn to steel in order to increase the strength of steel sheets. However, in the case of a steel sheet to which these chemical elements are added, oxides of Si and Mn are formed on the surface of the steel sheet in an annealing process before galvanizing is performed. In the case where oxides of Si and Mn are present on the surface of a steel sheet, it is difficult to achieve satisfactory zinc coatability.

From the results of investigations, by varying annealing conditions before the galvanizing process and by oxidizing Si and Mn inside a steel sheet so that the concentration of these chemical elements on the surface of the steel sheet is prevented, there is an increase in zinc coatability and there is an increase in the reactivity between a coating and the steel sheet, which results in an increase in coating adhesiveness.

In addition, in order to oxidize Si and Mn inside a steel sheet and prevent the concentration of these chemical elements on the surface of the steel sheet, it is effective to perform an oxidation treatment in an oxidation furnace before an annealing process and to thereafter perform reduction annealing, galvanizing, and an alloying treatment, and it is necessary to obtain a certain amount or more of iron oxides in the oxidation treatment. However, in the case where internal oxides of Si and Mn are formed in larger amounts than necessary, since the crystal grains of the base steel are taken into the coating layer through the internal oxides formed at the grain boundaries when an alloying treatment is performed, it is not always possible to obtain satisfactory corrosion resistance. This is thought to be because, since there is a decrease in relative zinc content, which is the main constituent of a coating layer, due to the base steel being taken into the coating layer, it is not possible to realize a sufficient sacrificial anticorrosive effect.

Figure 1:
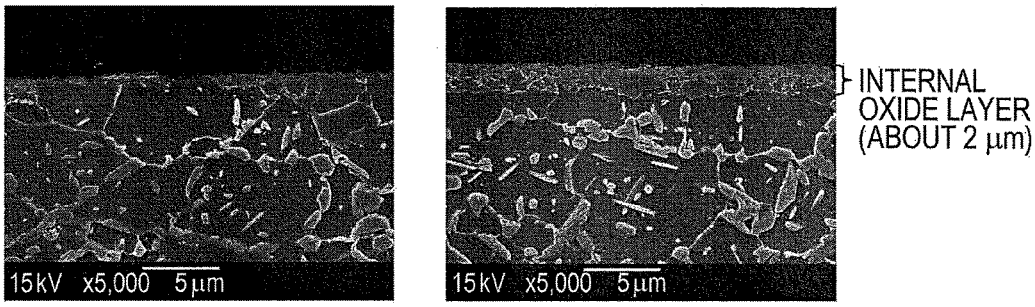
FIG. 1 is a diagram illustrating SEM images of the cross sections of steel sheets which have been subjected to an oxidation treatment and reduction annealing with a heating rate of 8° C./sec and 20° C./sec, respectively.

From the results of additional investigations, by appropriately controlling the average heating rate of a steel sheet, when an oxidation treatment is performed, to suppress internal oxides being formed in an excessive amount, it is possible to achieve satisfactory corrosion resistance. FIG. 1 illustrates the SEM images of the cross sections of steel sheets containing Si and Mn which were subjected to an oxidation treatment in a laboratory at heating rates of steel sheets of 8° C./sec and 20° C./sec respectively from room temperature to a temperature of 800° C. in an atmosphere of 2.0 vol $O_2$—$N_2$ and then which were subjected to reduction annealing at a temperature of 825° C. for 200 seconds in an atmosphere of $H_2$—$N_2$. It is clarified that, in the case where an oxidation treatment was performed with a heating rate of 20° C./sec, internal oxides were formed in the form of a layer along grain boundaries in the surface layer of the steel sheet in the region within about 2 μm from the surface of the steel sheet. On the other hand, the formation of an internal oxide layer was not observed in the surface layer of the steel sheet in the case where an oxidation treatment was performed with a heating rate of 8° C./sec.

Figure 2:
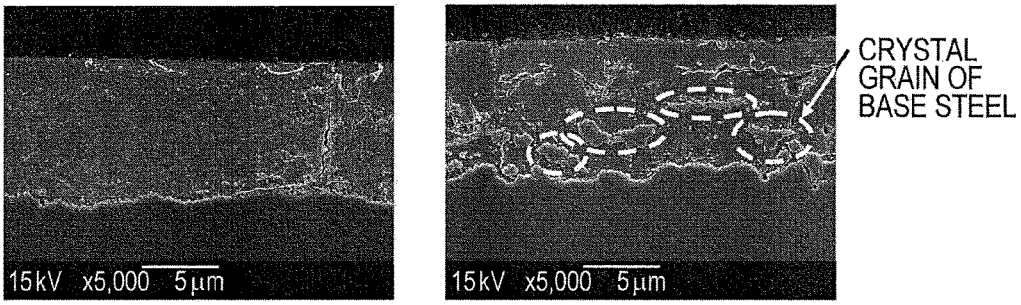
FIG. 2 is a diagram illustrating SEM images of the cross sections of steel sheets which have been subjected to an oxidation treatment, galvanizing, and an alloying treatment.

FIG. 2 illustrates the SEM images of the cross sections of the steel sheets which were furthermore subjected to galvanizing and an alloying treatment. While the crystal grains of base steel were taken into the coating layer in the locations which are indicated by dotted lines in the case of the steel sheet being subjected to an oxidation treatment with a heating rate of 20° C./sec, the take-in of the crystal grains of base steel was not observed in the case of the steel sheet which was subjected to an oxidation treatment with a heating rate of 8° C./sec. As described above, in order to suppress the take-in of the crystal grains of base steel into a coating layer, it is important to control the amount and shape of internal oxides after reduction annealing has been performed and that, therefore, it is important to control the heating rate of a steel sheet when an oxidation treatment is performed.

From the results described above, it is possible to suppress the crystal grains of base steel being taken into a coating layer by controlling the average heating rate of a steel sheet to be less than 10° C./sec in an oxidation treatment. However, limiting the average heating rate of a steel sheet in an oxidation treatment process to less than 10° C./sec causes a significant decrease in productivity. Therefore, additional investigations were conducted, and as a result, in a zone in which an atmosphere has an oxygen concentration of less than 1 vol % and a temperature is 500° C. or lower, since the oxidation reaction of a steel sheet is inhibited, it is not necessary to control the average heating rate of a steel sheet to be less than 10° C./sec. That is to say, it is effective to heat a steel sheet with an increased heating rate in the ranges of oxygen concentration and temperature in which the oxidation reaction of a steel sheet is inhibited.

From the results described above, in embodiments, an oxidation treatment process is performed in a zone in which an atmosphere has an oxygen concentration of less than 1 vol % under the conditions that the average heating rate of the steel sheet is 20° C./sec or more and the maximum temperature of the steel sheet is 400° C. or higher and 500° C. or lower in the former part of an oxidation treatment process. As the result, it is possible to increase productivity. In the case where the oxygen concentration is 1 vol % or more or where the maximum temperature is within a range higher than 500° C., it is necessary to limit the average heating rate to less than 10° C./sec in order to control the amount and shape of internal oxides as described above. Therefore, the upper limit of the maximum temperature is set to be 500° C. and the oxygen concentration is set to be less than 1 vol %, or preferably 0.5 vol % or less. In addition, in the case where the maximum temperature is lower than 400° C., since subsequent heating with a heating rate of less than 10° C./sec takes a long time, there is a decrease in productivity. Moreover, in order to increase productivity and in order to perform heating with a heating rate of 20° C./sec in a temperature range as wide as possible, it is more preferable that the maximum temperature be 450° C. or higher and 500° C. or lower.

Here, even if $N_2$ and inevitable impurity gases are contained in the atmosphere of an oxidation furnace, a sufficient effect can be realized as long as the oxygen concentration is within the specified range.

In addition, as described above, it is necessary to obtain a certain amount or more of iron oxides in an oxidation treatment in order to increase coating adhesiveness. Therefore, it is also necessary to control the average heating rate of a steel sheet to be less than 10° C./sec and to control the temperature of the steel sheet in a zone having an atmosphere of an oxygen concentration of 1 vol % or more where the oxidation reaction of the steel sheet markedly occurs. That is to say, disclosed embodiments are characterized in that an oxidation treatment is performed in a zone having an atmosphere of an oxygen concentration of 1 vol % or more under the condition that the maximum temperature of the steel sheet is 600° C. or higher in the latter part of an oxidation treatment process. With this process, there is an increase in coating adhesiveness. By controlling the average heating rate of a steel sheet to be less than 10° C./sec, since it is possible to suppress internal oxidation being formed at grain boundaries as illustrated in FIG. 2(*a*), it is possible to suppress the crystal grains of base steel being taken into a coating layer after galvanizing and an alloying treatment have been performed. In addition, in the case where the maximum temperature is lower than 600° C., since it is difficult to suppress Si and Mn being oxidized on the surface of a steel sheet in an annealing process, surface defects such as non-plating occur. It is preferable that the maximum temperature be 650° C. or higher. It is preferable that oxygen concentration in the atmosphere be 5 vol % or less.

In disclosed embodiments, the oxygen concentration is set to be low and the heating rate is set to be high in the lower temperature zone, which is the former part of an oxidation treatment process, and oxygen concentration is set to be high and the heating rate is set to be low in the higher temperature zone, which is the latter part of an oxidation treatment process. Subsequently, in disclosed embodiments, it is preferable that a process of further lower oxygen concentration be added. By controlling the oxygen concentration of the last process of an oxidation treatment to be low, the shapes of the oxides of Si and/or Mn which are formed at the interface between iron oxides and a steel sheet change. As a result, it is possible to more effectively prevent the surface concentration of Si and Mn in an annealing process. In addition, there is no particular limitation on a heating rate or temperature in the last process.

Figure 3:
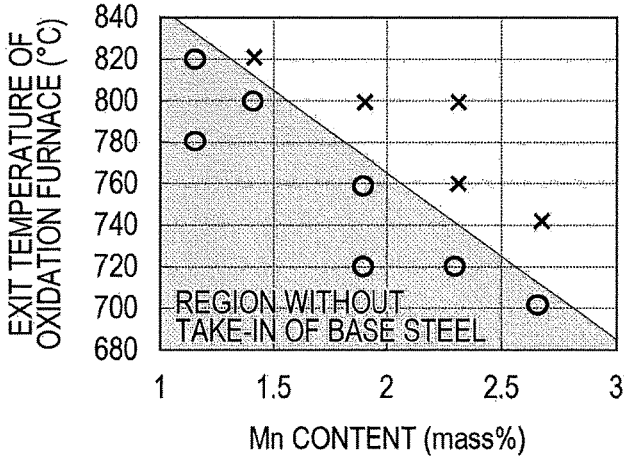
FIG. 3 is a diagram illustrating the relationship among Mn content, the exit temperature of an oxidation furnace, and the take-in of base steel.

In the case where Si and Mn are contained in steel in a large amount, there is an increase in the amount of internal oxides formed in a reduction annealing process. As described above, in the case where internal oxides of Si and Mn are formed in excessive amounts, a phenomenon in which the crystal grains of base steel are taken into a coating layer through internal oxides which are formed at grain boundaries occurs when galvanizing is performed and then an alloying treatment is performed. Then, in the case where the crystal grains of base steel are taken into a coating layer, there is a decrease in corrosion resistance. Therefore, it is necessary to perform an oxidation treatment under the conditions in accordance with the contents of Si and Mn. Accordingly, using steels having various contents of Si and Mn, investigation was conducted regarding the exit temperature of an oxidation furnace with which the crystal grains of base steel are not taken into a coating layer. FIG. 3 illustrates the regions with and without the take-in of the crystal grain of base steel in relation to Mn content and the exit temperature of an oxidation furnace (the oxygen concentration of the atmosphere was 2.0 vol %) in the case where steel having a Si content of 1.5% was used. In FIG. 3, a case without the take-in of base steel is represented by ○, and a case with the take-in of base steel is represented by x. Here, the judgment criteria are the same as those used in EXAMPLE described below. As indicated in FIG. 3, it is clarified that the take-in of base steel tends to occur in the case of steel having a high Mn content. Moreover, in the case where investigations similar to that described above were conducted using steels having various Si contents, the take-in of base steel tends to occur in the case of steel having a high Si content. From the results described above, in the case where the border between the range with the take-in of base steel and the range without the take-in of base steel is expressed by the equation (the exit temperature of an oxidation furnace)=X×[Mn]+Y, X is assigned a value of −80. Here, [Mn] represents Mn content (mass %) in the steel. In addition, Y is a value varying in accordance with Si content. From the results of investigations regarding the relationship between Y and Si content, it was found that the relationship is expressed by Y=−75×[Si]+1030. From the results described above, it was found that the exit temperature of an oxidation furnace with which base steel is not taken into a coating layer is expressed by the relational expression below.

$$T \leq -80[Mn]-75[Si]+1030 \quad (1),$$

where T represents the maximum temperature in the zone having an oxygen concentration of 1 vol % or more, [Mn] represents Mn content (mass %) in the steel sheet, and [Si] represents Si content (mass %) in the steel sheet. By controlling the maximum temperature in the zone having an oxygen concentration of 1 vol % or more in which an oxidation reaction markedly occurs, it is possible to suppress not only an internal oxide layer being formed but also base steel being taken into a coating layer.

As described above, it is preferable that heating be performed to a temperature satisfying relational expression (1) in an oxidation furnace, that is to say, it is preferable that the maximum temperature be T in a zone having an oxygen concentration of 1 vol % or more. By satisfying relational expression (1), since the crystal grains of base steel are not taken into a coating layer, satisfactory corrosion resistance is achieved.

Here, there is no particular limitation on what kind of corrosion testing method is used, and the examples of the test include an exposure test, a salt spray test, and a combined cyclic corrosion test in which salt spray, drying, and wetting are repeated at different temperatures, which are typically used. A combined cyclic corrosion test is conducted under various conditions. For example, a testing method prescribed in JASO M-609-91 or a corrosion testing method prescribed in SAE-J2334 provided by the Society of Automotive Engineers, Inc. may be used.

As described above, by controlling a heating rate and the maximum temperature when oxidation is performed, it is possible to achieve satisfactory coating adhesiveness and satisfactory corrosion resistance.

Here, at least in the case where the temperature of a steel sheet is higher than 500° C., the oxygen concentration of the atmosphere of an oxidation furnace is controlled to be 1 volt or more as described above. In addition, even if $N_2$, inevitable impurity gasses, or the like is contained in the atmosphere, a sufficient effect can be realized as long as the oxygen concentration is within the specified range.

There is no particular limitation on what kind of heating furnace is used for an oxidation treatment. In embodiments, it is preferable that a direct-fire heating furnace having direct fire burners be used. A direct fire burner is used to heat a steel sheet in such a manner that burner flames, which are produced by burning the mixture of a fuel such as a coke oven gas (COG) which is a by-product gas from a steel plant and air, come into direct contact with the surface of the steel sheet. In the case of using a direct fire burner, since the temperature of a steel sheet increases faster than in the case of heating using a radiant method, it is preferable that a direct fire burner be used for rapid heating at a heating rate of 20° C./sec or more in the former part of an oxidation treatment in embodiments. In addition, since it is possible to control a heating rate by adjusting the amounts of fuel and air used for burning and by controlling the temperature of the furnace, it is possible to use a direct fire burner for heating at a heating rate of less than 10° C./sec in the latter part of an oxidation treatment process in embodiments. Moreover, in the case where the air ratio of a direct fire burner is 0.95 or more, that is, the ratio of air to fuel is large, since unburned oxygen is left in the flames, it is possible to promote the oxidation of a steel sheet using the unburned oxygen. Accordingly, by adjusting the air ratio, it is also possible to control the oxygen concentration of the atmosphere. In addition, for example, a COG or a liquefied natural gas (LNG) may be used as a fuel for a direct fire burner.

After the oxidation treatment described above has been performed on a steel sheet, reduction annealing is performed. There is no particular limitation on what conditions are used for reduction annealing. In embodiments, it is preferable that an atmospheric gas fed into an annealing furnace contain 1 vol % or more and 20 vol % or less of $H_2$ and the balance being $N_2$ and inevitable impurities. In the case where the $H_2$ concentration in the atmospheric gas is less than 1 vol %, an amount of $H_2$ necessary to reduce iron oxides on the surface of a steel sheet is not sufficient. On the other hand, in the case where the $H_2$ concentration in the atmospheric gas is more than 20 vol %, reduction of Fe oxides saturates and the excess $H_2$ is wasted.

In addition, in the case where a dewpoint is higher than −25° C., since oxidation by oxygen from $H_2O$ in the furnace becomes notable, the internal oxidation of Si and Mn excessively occurs. Therefore, it is preferable that the dewpoint be −25° C. or lower. With this, since the annealing furnace is in a reducing atmosphere for Fe, the reduction of iron oxides formed in an oxidation treatment occurs. At this time, some of oxygen which has been separated from Fe by reduction diffuses inside a steel sheet and reacts with Si and Mn, so that the internal oxidation of Si and Mn occurs. Since there is a decrease in the amount of oxides of Si and Mn on the outermost surface of the steel sheet which comes into contact with a galvanizing layer due to Si and Mn being oxidized inside the steel sheet, there is an increase in coating adhesiveness.

It is preferable that reduction annealing be performed at a temperature of a steel sheet of 700° C. to 900° C. from the viewpoint of material conditioning. It is preferable that the soaking time be 10 to 300 seconds.

After reduction annealing has been performed, the steel sheet is cooled to a temperature of 440° C. to 550° C. and then subjected to galvanizing and an alloying treatment. For example, galvanizing is performed by using a galvanizing bath containing 0.08 to 0.18 mass of sol. Al and by dipping the steel sheet having a sheet temperature of 440° C. to 550° C. in the galvanizing bath, and the coating weight is adjusted by gas wiping or the like. It is appropriate that the temperature of the galvanizing bath be in the normal range of 440° C. to 500° C. An alloying treatment is performed by heating the steel sheet at a temperature of 460° C. or higher and 600° C. or lower for 10 to 60 seconds. There is a decrease in coating adhesiveness in the case where the heating temperature is higher than 600° C., and an alloying reaction does not progress in the case where the heating temperature is lower than 460° C.

In the case where an alloying treatment is performed, it is preferable that the treatment be performed so that the degree of alloying (Fe content (%) in the coating) is 7 mass % or more and 15 mass % or less. In the case where the content of Fe is less than 7 mass %, appearance is degraded due to a variation in the degree of alloying, and there is a decrease in slidability due to the formation of a ζ phase. In the case where the content is more than 15 mass %, there is a decrease in coating adhesiveness due to a hard and brittle F phase being formed in a large amount. It is more preferable that the content be 8 mass % or more and 13 mass % or less.

As described above, the high-strength galvanized steel sheet according to disclosed embodiments is manufactured.

Hereafter, the high-strength galvanized steel sheet which is manufactured using the manufacturing method described above will be described. Hereinafter, the contents of the constituent chemical elements of the chemical composition of steel and the contents of the constituent chemical elements of the chemical composition of a coating layer are expressed in units of "mass %", and "mass %" is simply represented by "%" unless otherwise noted.

First, the preferable chemical composition of steel will be described.

C: 0.01% or more and 0.20% or less

C facilitates an increase in the workability of a steel microstructure by promoting the formation of, for example, martensite. In order to realize such an effect, it is preferable that the C content be 0.01% or more. On the other hand, in the case where the C content is more than 0.20%, there is a decrease in weldability. Therefore, the C content is set to be 0.01% or more and 0.20% or less.

Si: 0.5% or more and 2.0% or less

Si is a chemical element which is effective for obtaining satisfactory properties for steel by strengthening steel. It is not economically preferable that the Si content be less than 0.5%, because expensive alloying chemical elements will be needed to achieve high strength. On the other hand, in the case where the Si content is more than 2.0%, it is difficult to achieve satisfactory coating adhesiveness, and an excessive amount of internal oxides is formed. Therefore, it is preferable that the Si content be 0.5% or more and 2.0% or less.

Mn: 1.0% or more and 3.0% or less

Mn is a chemical element which is effective for increasing the strength of steel. In order to achieve satisfactory mechanical properties and strength, it is preferable that the Mn content be 1.0% or more. In the case where the Mn content is more than 3.0%, it may be difficult to achieve satisfactory weldability or a satisfactory strength-ductility balance, and an excessive amount of internal oxides is formed. Therefore, it is preferable that the Mn content be 1.0% or more and 3.0% or less.

P: 0.025% or less

P is inevitably contained. In the case where the P content is more than 0.025%, there may be a decrease in weldability. Therefore, it is preferable that the P content be 0.025% or less.

S: 0.010% or less

S is inevitably contained. The lower limit of the S content is not specified. However, since there may be a decrease in weldability in the case where the S content is large, it is preferable that the S content be 0.010% or less.

Here, in order to control a strength-ductility balance, at least one element selected from among Cr: 0.01% or more and 0.8% or less, Al: 0.01% or more and 0.1% or less, B: 0.001% or more and 0.005% or less, Nb: 0.005% or more and 0.05% or less, Ti: 0.005% or more and 0.05% or less, Mo: 0.05% or more and 1.0% or less, Cu: 0.05% or more and 1.0% or less, and Ni: 0.05% or more and 1.0% or less may be added as needed. The reasons for the limitations on the appropriate contents of these chemical elements in the case where these chemical elements are added will be described hereafter.

In the case where the Cr content is less than 0.01%, it may be difficult to achieve satisfactory hardenability, and there may be a decrease in strength-ductility balance. On the other hand, in the case where the Cr content is more than 0.8%, there is an increase in cost.

Since Al is most susceptible to oxidation in thermodynamic terms, Al is oxidized prior to Si and Mn, which has the effect of promoting the oxidation of Si and Mn. Such an effect is realized in the case where the Al content is 0.01% or more. On the other hand, in the case where the Al content is more than 0.1%, there is an increase in cost.

It is difficult to realize the effect of increasing hardenability in the case where the B content is less than 0.001%, and there is a decrease in coating adhesiveness in the case where the B content is more than 0.005%.

It is difficult to realize the effects of adjusting strength and increasing coating adhesiveness when Nb is added in combination with Mo in the case where the Nb content is less than 0.005%, and there is an increase in cost in the case where the Nb content is more than 0.05%.

It is difficult to realize the effect of adjusting strength in the case where the Ti content is less than 0.005%, and there is a decrease in coating adhesiveness in the case where the Ti content is more than 0.05%.

It is difficult to realize the effects of adjusting strength and increasing coating adhesiveness when Mo is added in combination with Nb or Ni and Cu in the case where the Mo content is less than 0.05%, and there is an increase in cost in the case where the Mo content is more than 1.0%.

It is difficult to realize the effects of promoting the formation of a retained γ phase and increasing coating adhesiveness when Cu is added in combination with Ni and Mo in the case where the Cu content is less than 0.05%, and there is an increase in cost in the case where the Cu content is more than 1.0%.

It is difficult to realize the effects of promoting the formation of a retained γ phase and increasing coating adhesiveness when Ni is added in combination with Cu and Mo in the case where the Ni content is less than 0.05%, and there is an increase in cost in the case where the Ni content is more than 1.0%.

The balance of the chemical composition consists of Fe and inevitable impurities other than the chemical elements described above.

EXAMPLE 1

By performing hot rolling, pickling, and cold rolling using a known method on cast pieces which had been manufactured from molten steels having the chemical compositions given in Table 1, cold-rolled steel sheets having a thickness of 1.2 mm were obtained.

TABLE 1

(mass %)

| Steel Code | C | Si | Mn | P | S |
|---|---|---|---|---|---|
| A | 0.11 | 0.6 | 1.9 | 0.01 | 0.001 |
| B | 0.12 | 0.9 | 1.4 | 0.01 | 0.001 |
| C | 0.10 | 1.0 | 2.5 | 0.01 | 0.001 |
| D | 0.08 | 1.5 | 2.6 | 0.01 | 0.001 |
| E | 0.09 | 2.2 | 1.5 | 0.01 | 0.001 |
| F | 0.06 | 0.3 | 3.2 | 0.01 | 0.001 |

Subsequently, the cold-rolled steel sheets described above were heated using a CGL having a DFF type (direct fired furnace type) oxidation furnace with an exit temperature of the oxidation furnace being appropriately varied. A COG was used as a fuel for the direct fire burners, and the oxygen concentration of the atmosphere was adjusted by adjusting an air ratio. In addition, a heating rate was varied by adjusting the combustion amount of the fuel gas. The temperature of the steel sheet at the exit of the DFF type oxidation furnace was determined using a radiation thermometer. Here, the oxidation furnace was divided into three zones (oxidation furnace 1, oxidation furnace 2, and oxidation furnace 3), and the heating rate and the oxygen concentration of atmosphere of each zone were adjusted by varying a combustion rate and air ratio for each zone. Subsequently, reduction annealing was performed in a reduction zone at a temperature of 850° C. for 200 seconds, galvanizing was performed using a galvanizing bath having an Al content of 0.13% and a bath temperature of 460° C., and then coating weight was adjusted to be about 50 g/m$^2$ by gas wiping. Subsequently, an alloying treatment was performed at a temperature of 480° C. to 600° C. for 20 to 30 seconds. Fe content was adjusted to be 7 to 15 mass % in the coating layer.

The appearance and coating adhesiveness of the galvannealed steel sheets obtained as described above were evaluated. Moreover, the take-in of the crystal grains of base steel into a coating layer and corrosion resistance were investigated.

The observation methods and evaluation methods will be described hereafter.

Regarding appearance, the appearance after an alloying treatment was evaluated by performing visual test, and a case where a variation in the degree of alloying or a bare spot was not observed was judged as ○, a case where a variation in the degree of alloying or a bare spot was slightly observed was judged as Δ, and a case where a variation in the degree of alloying or a bare spot was clearly observed was judged as x.

Regarding evaluation of coating adhesiveness, by sticking Cellotape (registered trademark) to the galvanized steel sheet, a peeling amount per unit length was determined from a Zn count number observed using fluorescent X-rays when the stuck surface was subjected to a 90 degree bending-unbending test, and, on the basis of the standard below, a case corresponding to rank 1 or 2 was judged as good (⊙), a case corresponding to rank 3 was judged as good (○), and a case corresponding to rank 4 or more was judged as poor (x). Fluorescent X-Rays Count Number and Rank 0 or more and less than 500: 1 (good)
500 or more and less than 1000: 2
1000 or more and less than 2000: 3
2000 or more and less than 3000: 4
3000 or more: 5 (poor)

The take-in of the crystal grains of base steel into a coating layer was evaluated using the following method. The sample which had been subjected to an alloying treatment was embedded in an epoxy resin and polished, and then the backscattered electron image of the sample was observed using a SEM. Since the contrast of a backscattered electron image varies in accordance with an atomic number, it is possible to clearly distinguish a coating layer portion from a base steel portion. Therefore, from the results of the observation of the images, a case where the take-in of the crystal grains of base steel into a coating layer clearly occurred was judged as x, a case where the take-in of the crystal grains of base steel slightly occurred was judged as Δ, and a case where the take-in of the crystal grains of base steel did not occur was judged as ○.

Corrosion resistance was evaluated using the following method. A combined cyclic corrosion test consisting of a drying process, a wetting process, and a salt spray process prescribed in SAE-J2334 was performed on the samples which had been subjected to an alloying treatment. Corrosion resistance was evaluated based on the maximum corrosion depth which was determined using a point micrometer after the coating and rust had been removed (dipping in a diluted hydrochloric acid solution).

The results obtained as described above are given in Table 2 along with the manufacturing conditions.

TABLE 2

| | | Oxidation Furnace 1 | | | Oxidation Furnace 2 | | | Oxidation Furnace 3 | | |
|---|---|---|---|---|---|---|---|---|---|---|
| No. | Steel Grade | Oxygen Concentration (vol %) | Average Heating Rate (° C./sec) | Maximum Temperature (° C.) | Oxygen Concentration (vol %) | Average Heating Rate (° C./sec) | Maximum Temperature (° C.) | Oxygen Concentraion (vol %) | Average Heating Rate (° C./sec) | Maximum Temperature (° C.) |
| 1 | A | 0.5 | 21 | 260 | 0.1 | 21 | 470 | 1.5 | 8 | 550 |
| 2 | A | 0.1 | 21 | 280 | 0.1 | 20 | 500 | 1.5 | 9 | 600 |
| 3 | A | 0.5 | 24 | 430 | 1.0 | 9 | 580 | 1.0 | 7 | 690 |
| 4 | B | 0.1 | 21 | 260 | 0.1 | 21 | 470 | 2.0 | 8 | 550 |
| 5 | B | 0.5 | 21 | 280 | 0.1 | 20 | 500 | 2.0 | 9 | 600 |
| 6 | B | 0.5 | 24 | 430 | 1.0 | 9 | 580 | 1.0 | 7 | 690 |
| 7 | B | 0.1 | 21 | 260 | 0.1 | 21 | 470 | 0.5 | 13 | 600 |
| 8 | C | 0.1 | 24 | 460 | 2.0 | 9 | 620 | 2.0 | 9 | 780 |
| 9 | C | 0.1 | 24 | 460 | 2.0 | 8 | 600 | 2.0 | 8 | 740 |
| 10 | C | 0.5 | 22 | 270 | 0.1 | 21 | 480 | 2.0 | 20 | 680 |
| 11 | C | 0.5 | 24 | 520 | 2.0 | 5 | 620 | 2.0 | 5 | 720 |
| 12 | C | 0.5 | 23 | 460 | 2.0 | 7 | 580 | 2.0 | 6 | 680 |
| 13 | C | 0.1 | 23 | 410 | 2.0 | 11 | 580 | 2.0 | 11 | 750 |
| 14 | D | 0.1 | 23 | 470 | 1.3 | 6 | 580 | 1.3 | 6 | 680 |
| 15 | D | 0.5 | 23 | 460 | 2.0 | 8 | 600 | 2.0 | 7 | 730 |
| 16 | D | 0.1 | 25 | 500 | 2.0 | 6 | 600 | 2.0 | 6 | 700 |
| 17 | D | 0.1 | 24 | 490 | 2.0 | 9 | 650 | 0.1 | 3 | 710 |
| 18 | D | 2.0 | 25 | 300 | 2.0 | 22 | 520 | 2.0 | 18 | 700 |
| 19 | D | 0.1 | 23 | 400 | 2.0 | 9 | 540 | 2.0 | 9 | 680 |
| 20 | E | 0.1 | 23 | 460 | 2.0 | 8 | 600 | 2.0 | 7 | 730 |

TABLE 2-continued

| | | | | | | | | | | |
|---|---|---|---|---|---|---|---|---|---|---|
| 21 | E | 0.5 | 23 | 470 | 2.0 | 6 | 580 | 2.0 | 6 | 680 |
| 22 | F | 0.1 | 23 | 460 | 2.0 | 8 | 600 | 2.0 | 7 | 730 |
| 23 | F | 0.1 | 23 | 470 | 2.0 | 6 | 580 | 2.0 | 6 | 680 |

| | Average Heating Rate and Corresponding Oxidation Furnace | | | | | | | Take-in of Base | | |
|---|---|---|---|---|---|---|---|---|---|---|
| No. | $O_2$ Less than 1% vol % (° C./sec) | Oxidation Furnace | $O_2$ 1% vol % or More (° C./sec) | Oxidation Furnace | Judgement *1 | Coating Appearance | Coating Adhesiveness | Steel into Coating Layer | Maximum Corrosion Depth mm | Note |
| 1 | 21 | 1, 2 | 8 | 3 | ○ | X | X | ○ | 0.45 | Comparative Example |
| 2 | 21 | 1, 2 | 9 | 3 | ○ | ○ | ○ | ○ | 0.38 | Example |
| 3 | 24 | 1 | 8 | 2, 3 | ○ | ○ | ⊙ | ○ | 0.41 | Example |
| 4 | 21 | 1, 2 | 8 | 3 | ○ | X | X | ○ | 0.31 | Comparative Example |
| 5 | 21 | 1, 2 | 9 | 3 | ○ | ○ | ○ | ○ | 0.31 | Example |
| 6 | 24 | 1 | 8 | 2, 3 | ○ | ○ | ⊙ | ○ | 0.48 | Example |
| 7 | 18 | 1, 2, 3 | — | — | — | X | X | ○ | 0.59 | Comparative Example |
| 8 | 24 | 1 | 9 | 2, 3 | X | ○ | ⊙ | Δ | 0.55 | Example |
| 9 | 24 | 1 | 8 | 2, 3 | ○ | ○ | ⊙ | ○ | 0.35 | Example |
| 10 | 22 | 1, 2 | 20 | 3 | ○ | ○ | ⊙ | X | 0.66 | Comparative Example |
| 11 | 24 | 1 | 5 | 2, 3 | ○ | ○ | ⊙ | X | 0.68 | Comparative Example |
| 12 | 23 | 1 | 7 | 2, 3 | ○ | ○ | ⊙ | ○ | 0.37 | Example |
| 13 | 24 | 1 | 11 | 2, 3 | ○ | ○ | ⊙ | X | 0.60 | Comparative Example |
| 14 | 23 | 1 | 6 | 2, 3 | ○ | ○ | ⊙ | ○ | 0.44 | Example |
| 15 | 23 | 1 | 8 | 2, 3 | X | ○ | ⊙ | Δ | 0.56 | Example |
| 16 | 25 | 1 | 6 | 2, 3 | ○ | ○ | ⊙ | ○ | 0.38 | Example |
| 17 | 24 | 1 | 9 | 2 | ○ | ○ | ⊙ | ○ | 0.36 | Example |
| 18 | — | — | 22 | 1, 2, 3 | ○ | ○ | ⊙ | X | 0.61 | Comparative Example |
| 19 | 23 | 1 | 9 | 2, 3 | ○ | ○ | ⊙ | ○ | 0.48 | Example |
| 20 | 23 | 1 | 8 | 2, 3 | ○ | ○ | ○ | ○ | 0.41 | Example |
| 21 | 23 | 1 | 6 | 2, 3 | ○ | Δ | ○ | ○ | 0.48 | Example |
| 22 | 23 | 1 | 8 | 2, 3 | ○ | ○ | ○ | ○ | 0.51 | Example |
| 23 | 23 | 1 | 6 | 2, 3 | ○ | Δ | ○ | ○ | 0.46 | Example |

(*) An underlined portion indicates a value out of the range according to disclosed embodiments.

*1 T ≤ −80[Mn] − 75[Si] + 1030: ○ T > −80[Mn] − 75[Si] + 1030: X Here, [Si], [Mn], and [Cr] respectively represent the contents (mass %) of Si, Mn, and Cr in steel, and T represents the maximum end-point temperature in a zone having an oxygen concentration of 1 vol % or more.

As Table 2 indicates, it is clarified that the galvannealed steel sheets (examples of disclosed embodiments) manufactured using the method according to embodiments were excellent in terms of coating adhesiveness and coating appearance despite being high-strength steel containing Si and Mn. Moreover, these examples were excellent in terms of corrosion resistance without the crystal grains of base steel being taken into a coating layer. On the other hand, the galvanized steel sheet (comparative examples) manufactured using methods out of the range of disclosed embodiments were poor in terms of one or more of coating adhesiveness, coating appearance, and corrosion resistance.

INDUSTRIAL APPLICABILITY

Since the high-strength galvanized steel sheet according to embodiments is excellent in terms of coating adhesiveness and fatigue resistance, the steel sheet can be used as a surface-treated steel sheet for the weight reduction and strengthening of automobile bodies.

The invention claimed is:

1. A method for manufacturing a galvannealed steel sheet, the method comprising:

providing a steel sheet having a chemical composition comprising:

C: 0.01 or more and 0.20 or less, by mass %;

Si: 0.5 or more and 2.0 or less, by mass %;

Mn: 1.0 or more and 3.0 or less, by mass %; and

Fe and unavoidable impurities;

performing a first oxidation treatment on the steel sheet in a first zone having an atmosphere with an oxygen concentration in the range of more than 0 vol % and less than 1 vol % under conditions that an average heating rate of the steel sheet is in the range of 20° C./sec or more and a temperature $T_1$ in the first zone is in the range of 400° C. to 500° C.;

thereafter performing a second oxidation treatment on the steel sheet in a second zone having an atmosphere with an oxygen concentration in the range of 1 vol % or more under conditions that an average heating rate of the steel sheet is in the range of less than 10° C./sec and a temperature $T_2$ in the second zone is in the range of 600° C. to 780° C.;

thereafter reduction annealing and galvanizing the steel sheet to form a galvanized steel sheet; and further performing an alloying treatment by heating the galvanized steel sheet at a temperature in the range of 460° C. to 600° C. for a duration in the range of 10 seconds to 60 seconds.

2. The method for manufacturing the galvannealed steel sheet according to claim 1, wherein the temperature $T_2$ in the second zone having the oxygen concentration of 1 vol % or more further satisfies the relational expression below:

$T_2 \leq -80[Mn]-75[Si]+1030$, where

[Si] represents Si content by mass % in the steel sheet, and

[Mn] represents Mn content by mass % in the steel sheet.

3. The method for manufacturing the galvannealed steel sheet according to claim 1, wherein the oxygen concentration of the atmosphere of the first zone is in the range of 0.1 vol % to less than 1 vol %.

4. The method for manufacturing the galvannealed steel sheet according to claim 1, wherein the galvannealed steel sheet has a tensile strength TS in the range of 440 MPa or more.

5. The method for manufacturing the galvannealed steel sheet according to claim 2, wherein the galvannealed steel sheet has a tensile strength TS in the range of 440 MPa or more.

6. The method for manufacturing the galvannealed steel sheet according to claim 3, wherein the galvannealed steel sheet has a tensile strength TS in the range of 440 MPa or more.

* * * * *